US007238276B2

(12) United States Patent
Fang et al.

(10) Patent No.: US 7,238,276 B2
(45) Date of Patent: Jul. 3, 2007

(54) MEDIUM-PRESSURE HYDROCRACKING PROCESS

(75) Inventors: Xiangchen Fang, Liaoning Provence (CN); Ling Lan, Liaoning Province (CN); Xiaobing Song, Liaoning Provence (CN); Minghua Guan, Liaoning Provence (CN); Guang'an Jiang, Liaoning Provence (CN); Fenglai Wang, Liaoning Province (CN); Zhengnan Yu, Liaoning Province (CN); Qun Guo, Beijing (CN)

(73) Assignees: China Petroleum Corporation, Beijing (CN); Fushun Research Institute of Petroleum and Petrochemicals, Liaoning Provence (CN)

( * ) Notice: Subject to any disclaimer, the term of this patent is extended or adjusted under 35 U.S.C. 154(b) by 349 days.

(21) Appl. No.: 10/842,814

(22) Filed: May 11, 2004

(65) Prior Publication Data

US 2004/0206668 A1 Oct. 21, 2004

Related U.S. Application Data

(63) Continuation-in-part of application No. 09/860,353, filed on May 18, 2001, now abandoned.

(30) Foreign Application Priority Data

May 19, 2000 (CN) ..... 00 1 10437

(51) Int. Cl.
*C10G 65/12* (2006.01)

(52) U.S. Cl. ..... 208/58; 208/97

(58) Field of Classification Search ..... 208/58, 208/97

See application file for complete search history.

(56) References Cited

U.S. PATENT DOCUMENTS

| | | | | |
|---|---|---|---|---|
| 4,172,815 | A | | 10/1979 | Jacobs |
| 4,971,680 | A | | 11/1990 | Kukes et al. |
| 5,026,472 | A | | 6/1991 | Hoehn et al. |
| 5,364,514 | A | * | 11/1994 | Sanborn et al. ..... 208/58 |
| 5,447,621 | A | | 9/1995 | Hunter |
| 6,043,178 | A | | 3/2000 | Ge et al. |

FOREIGN PATENT DOCUMENTS

| | | |
|---|---|---|
| CN | 1049800 | 3/1991 |
| CN | 1053636 | 8/1991 |

* cited by examiner

*Primary Examiner*—Glenn Caldarola
*Assistant Examiner*—Prem C. Singh
(74) *Attorney, Agent, or Firm*—Cohen Pontani Lieberman & Pavane LLP

(57) ABSTRACT

The present invention relates to a medium-pressure hydrocracking process which uses a fresh hydrogen resource and a hydrosaturation catalyst with reduced metals of group VIB and/or group VIII as the active ingredients to selectively and deeply hydrosaturate jet fuel and/or diesel cuts derived in the medium-pressure hydrocracking process.

20 Claims, 2 Drawing Sheets

MEDIUM-PRESSURE HYDROCRACKING PROCESS

CROSS REFERENCE TO RELATED APPLICATIONS

This application is a continuation-in-part of U.S. patent application Ser. No. 09/860,353, filed with the U.S. Patent and Trademark Office on May 18, 2001 now abandoned; which further claims the priority date of Chinese patent application Serial No. 00110437.3 filed on May 19, 2000.

BACKGROUND OF THE INVENTION

1. Field of the Invention

The present invention relates to a process for producing high quality motor fuels, especially a medium-pressure hydrocracking process, from low quality heavy oils.

2. Description of the Related Art

Along with the continuous development of the world economy, the demand of the market for the petrochemical products is continuously increasing. However, the resource of low sulfur crude oil in many countries is insufficient. Therefore there is a need to process a great amount of imported high sulfur crude oil. This sets a task in front of most refineries with FCC as the main equipment as to how to reform so as to meet the need of processing high-sulfur crude oil. The experience in processing high-sulfur crude oil in various countries shows that the hydrocracking process is a major means to convert high sulfur heavy oils. However, the high investment resulted from the high-pressure hydrocracking, equipment and the great demand for the hydrogen resource greatly limits the rapid development of the hydrocracking process. Therefore refiners are eager to find out a new process for solving this problem.

Hydrocracking is generally operated at a pressure level of 15.0 MPa and has many advantages such as high operation flexibility, high product quality, etc., but also has such disadvantages as a high investment in the construction and a high consumption of hydrogen. The disadvantages are more severe when there is lack of funds and of cheap hydrogen sources such as natural gas. However, because of the various advantages exhibited by the hydrocracking process in processing high sulfur crude oil, the hydrocracking process still possesses superior status and function to those non-hydrotreating processes, and therefore becomes one of the first choices made by refinery engineers in processing high sulfur crude oil. In order to overcome the shortcomings of the hydrocracking, technology, people started to explore long ago to find out whether it is possible to lower the operation pressure of the hydrocracking process and have made great advances. Medium-pressure hydrocracking or medium-pressure hydroupgrading technologies have been successfully developed (e.g. U.S. Pat. No. 4,971,680), with an operation pressure being about 8.0 MPa. The product quality is greatly affected in the medium-pressure hydrocracking due to the intrinsic shortcoming of low saturation extent of aromatics limited by the thermodynamic equilibrium. Particularly to the jet fuel, since a great amount of aromatics are transferred during the reaction to such a cut fraction and can not be saturated effectively, its quality specifications such as the smoking point, etc., can not meet the requirements. This greatly limits the scope of the lowering in the operation pressure of the medium-pressure hydrocracking process. Nowadays, the operation pressure industrially adopted in the medium-pressure hydrocracking processes is about 10.0 MPa, and most of the processes can not be directly used to produce jet fuel. Also, the quality of diesel is hard to attain the specifications of the World Standard III for diesel. The improving effect of lowering the operation pressure on the investment and operating cost is not distinct, but the product quality is lowed sharply. Therefore, there has not been a breakthrough in the development and application of the medium-pressure hydrocracking process for a long time.

U.S. Pat. No. 4,172,815 describes a process for producing jet fuel and diesel wherein the tail oil is completely recycled. Heavy cut fractions pass through a hydrocracking reactor, and the jet fuel fraction in the effluent is then fractionated out and partly recycled so that the smoking point of the jet fuel is raised. But this process has obvious disadvantages so that it is only applicable to those process flows wherein the smoking point of the jet fuel is relatively high and therefore an elevation thereof of only 2–3 mm would meet the requirement. However, the smoking point of the jet fuel produced in a medium-pressure hydrocracking process is generally lower than 20 mm, and therefore the use of this process is restricted under medium pressures. Especially, the recycle of a part of the jet fuel will certainly lower its yield and affect the capacity of the hydrocracking equipment or increase the investment in the hydrocracking equipment.

U.S. Pat. No. 5,026,472 discloses a process, wherein the jet fuel cut and the hydrogen-containing vapor in the effluent of the hydrocracking are separated by adjusting the pressure and temperature of a two stage vapor-liquid separator, and the separated jet fuel and a part of the hydrogen-containing vapor enter into a hydrogenation reactor for hydrogenation of the jet fuel, while the remaining hydrogen-containing vapor enters the hydrocracking reactor. Because of the post-processing of the jet fuel component, a qualified jet fuel product can be produced under a medium to high pressure. But the disadvantages are that the process flow is complex, the amount of high-pressure equipment is great, and the increase in the investment is more, so that the superiority of the medium-pressure can not be materialized. And since the oil vapor entering the refining reactor still contains a great amount of impurities such as $H_2S$, $NH_3$, $H_2O$, etc., the hydrosaturation performance of the catalyst in the hydrogenation reactor of the jet fuel degrades, and the sorts of the applicable hydrogenation catalysts are limited too. For instance, most of the noble metal catalysts or non-noble metal saturation catalysts in reduced states are not applicable.

U.S. Pat. No. 5,447,621 (Hunter) discloses a hydrocracking process which involves an initial hydrocracking step. Hunter discloses that the desired fuel cuts from the hydrocracking step can be further saturated, at a temperature of from 250 to 350° C., a pressure of from about 3 to about 7 MPa, in the presence of a CoMo or NiMo base metal or a noble metal catalyst (see e.g. col. 8, lines 15–20). The elevated pressure employed by Hunter may be consistent with the knowledge of a skilled artisan in the art that the conversion of the hydrogenation reaction of aromatics increases with the increase of the reaction pressure. Nevertheless, due to the employment of the elevated pressure, Hunter requires the use of additional equipment to pressurize the industrial hydrogen source. Specifically, industrial hydrogen is generally supplied at pressure below 3 MPa (e.g. the pressure of the industrial hydrogen produced from light hydrocarbon after purification is generally about 1–2.5 MPa, and the pressure of the by-product hydrogen from the catalytic reforming of naphtha is generally about 0.8–2.5 MPa). In addition, due to the elevated hydrosaturation temperature employed by Hunter, the feed may need to conduct heat-exchange with the effluents from the hydrosaturation reactor and hydrocracking reactor to attain the temperature necessary for the reaction, which apparently cannot meet the desirability of simplifying the process flow and equipments.

SUMMARY OF THE INVENTION

The objective of the present invention is to develop a medium-pressure hydrocracking process, which shall retain the above-mentioned advantages of hydrocracking process, while overcoming its shortcomings of high investment and high consumption of hydrogen. To be more exact, the purpose of the present invention is to solve the quality problem of the product brought about by the insufficient saturation of aromatics, especially the quality problem of the jet fuel product.

Yet another object of the present invention is to overcome the shortcomings of medium-pressure hydrocracking process that it is difficult to directly produce qualified jet fuel and high quality diesel, thereby improving its practicability In accordance with the present invention, we provide a medium-pressure hydrocracking process comprising the steps of: contacting feed oil with a hydrocracking catalyst in a hydrocracking system under a medium pressure and hydrocracking conditions; separating the hydrocracking reaction product into a vapor fraction which is recycled to the hydrocracking system as recycling hydrogen, and a liquid fraction which is further separated in a separating system to produce distillates including jet fuel and/or diesel (hereinafter referred to as hydrocracked jet fuel and/or diesel) cuts; feeding a part or all of the hydrocracked jet fuel and/or diesel cuts into a hydrosaturation system where the cuts come into contact with a hydrosaturation catalyst and react with hydrogen under hydrosaturation conditions; separating the hydrosaturation reaction product into a hydrogen-containing vapor which enters into the hydrocracking system as make-up hydrogen, and jet fuel and/or diesel (hereinafter referred to as the hydrosaturated jet fuel and/or diesel) which enter into a separation system for processing. The medium pressure herein refers to a pressure of from about 4.0 to about 10.0 MPa. The hydrosaturation reaction is carried out under a pressure of 0.5–3.0 MPa, at a temperature of 100–280° C.

Preferably, the hydrosaturation reaction is carried out under a temperature of 100–250° C., a pressure of 1.0–2.0 MPa. More preferably, the hydrosaturation reaction is carried out in the presence of a reduced hydrosaturation catalyst comprising at least 30 wt % of nickel based on its oxide. More particularly, the hydrosaturation catalyst comprises 30 wt %–70 wt % nickel based on its oxide. In another preferred embodiment, the hydrosaturation catalyst comprises at least 50 wt %, preferably at least 54 wt %, more preferably from 54 wt % to 63 wt % of nickel based on its oxide.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
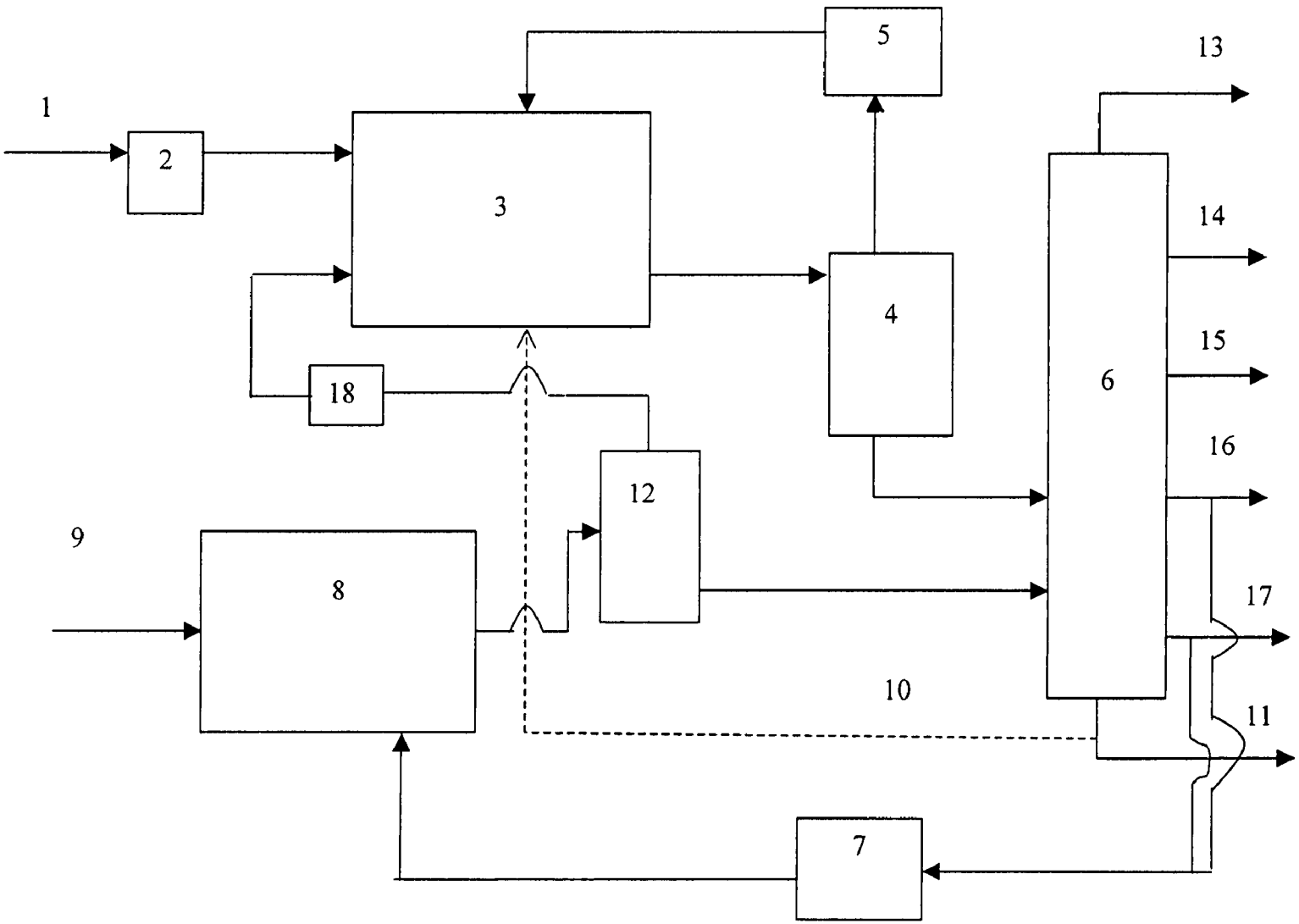
FIG. 1 shows an embodiment of the present invention, in which the hydrosaturated product and the hydrocracked, separated liquid product enter the same separation system.

The major problem of the hydrocracking under a lowered pressure is the increased aromatics content in the product resulted from the insufficient hydrogenation capacity. For naphtha, the increase in the aromatics content does not bring about adverse effects because naphtha can be used as a reforming feed, and oppositely, the increase in the aromatics content can reduce the severity of the operation of the catalytic reforming and the unnecessary consumption of hydrogen. For the diesel cut, the quality specifications such as cetane number, etc., are greatly surplus because the content of aromatics in the corresponding product of high-pressure hydrocracking is low. When the operation pressure is lowered, the hydrogen consumption and the hydrosaturation depth are lowered, but the requirement for the quality specifications can still be met in many cases, and the process becomes more reasonable from the economic viewpoint. However, the content of aromatics is an important factor affecting the quality of the product jet fuel. The content of aromatics and the smoking point are two key specifications of jet fuel, and the higher the content of aromatics, the lower the smoking point is. In most cases, the specifications of the jet fuel produced in medium-pressure hydrocracking, such as the content of aromatics, the smoking point, etc., are not qualified. The factors affecting the activity of the hydrosaturation in the hydrocracking process are of both kinetic and thermodynamic aspects. Kinetically, the activity of the hydrogenation component in the catalyst is very high, but the hydrogenation activity of the catalyst can not fully bring into play because of the poisoning effects of $H_2S$, $NH_3$ and the impurities such as organic sulfur nitrogen, etc. in the feed. Therefore, the reaction temperature has to be raised so that the reaction can be accelerated, and the cracking reaction generally demands relatively high temperatures. However, high temperatures are thermodynamically unfavorable to the hydrosaturation reaction. Under the conditions of the high-pressure hydrocracking, the partial pressure of hydrogen can compensate the adverse effects of the temperature on the thermodynamic equilibrium, while under the conditions of the medium-pressure hydrocracking, the effects of the reaction temperature on the thermodynamic equilibrium attain an extent that can not be neglected.

For convenience of description, the medium-pressure hydrocracking unit of the present invention is divided into a medium-pressure hydrocracking system, a hydrosaturation system, and a separation system. The medium-pressure hydrocracking system consists of a hydrocracking equipment (such as a reactor) and heating and heat-exchanging equipment where necessary. The flow of the medium-pressure hydrocracking system can be particularly designed according to the practical needs. For example, it may be a single stage hydrocracking flow, i.e., the feed oil directly enters into a reactor in which a hydrocracking catalyst is charged to carry out the reaction, without a pre-reaction section for hydrotreating being equipped; or it may also be a two-stage hydrocracking flow, i.e., including a hydrotreating section and a hydrocracking section, so that the feed oil first enters into the hydrotreating section, in which such impurities as $H_2S$ and $NH_3$ are removed from the reactants, and then enters into the hydrocracking section for cracking. Of course, the process flow may also comprise a hydrotreating section and a hydrocracking section, in which the reactants from the hydrotreating section directly enter into the hydrocracking section without first removing the impurities such as $H_2S$, $NH_3$, etc. therefrom. The hydrosaturation system consists of a hydrosaturation reactor and a liquid-vapour separator. The separation system may be selected, according to the particular situation, from a group consisting of a low separator, a stripping tower, a fractionation tower, etc.

According to the present invention, the feed oil enters into a medium-pressure hydrocracking system under a medium pressure and hydrocracking conditions to carry out the reaction, and the reaction product is separated into vapor and liquid phases in, for example, a high pressure vapor-liquid separator. The vapor phase product is recycled to said medium-pressure hydrocracking system as recycling hydrogen; and the liquid phase enters into a separation system, wherein it is separated into distillates including jet fuel and/or diesel (hereinafter referred to as hydrocracked jet fuel and/or diesel) cuts, for example, liquefied petroleum gas, naphtha, jet fuel, diesel, and tail oil. Then, a part or all of the hydrocracked jet fuel and/or diesel cuts enter a hydrosaturation system, comes into contact with a hydrosaturation catalyst and reacts with fresh hydrogen under hydrosaturation conditions. The hydrosaturation reaction product is then separated through a vapor-liquid separator into a hydrogen-containing vapor which enters into the medium-pressure hydrocracking system as make-up hydrogen, and jet fuel and/or diesel (hereinafter refered to as the hydrosaturated jet fuel and/or diesel) which enter into a separation system for processing.

As mentioned above, the jet fuel produced from a medium-pressure hydrocracking treatment is not easy to meet the required specifications, while sometimes the produced diesel can. So, if the quality of the diesel happens to meet the specifications, only the jet fuel separated in the separation system shall be sent to a hydrosaturation system for further processing. However, if neither the diesel nor the jet fuel meets the specifications, both of them can be sent together to a hydrosaturation system for further processing. Of course, it is certainly permissible to merely send diesel to a hydrosaturation system for processing according to certain particular situations.

Said hydrosaturated jet fuel and/or diesel derived in the above process of the present invention preferably enter into an individual separation system for processing. In case that jet fuel and diesel are hydrosaturated together, the mixed distillate of jet fuel and diesel can be separated through said individual separation system and may separately leave the equipment. If merely one of them is required to enter into a hydrosaturation system for processing, or jet fuel and diesel separately enter into the hydrosaturation system without mixing, the hydrosaturated jet fuel or diesel may leave the equipment as products merely by simple stripping without any further processing.

In case that the hydrosaturated jet fuel and/or diesel enter into an individual separation system for processing, the hydrocracked jet fuel and/or diesel cuts may either completely or partly enter into the hydrosaturation system for processing and the remainder (where partly entering) is mixed together with the corresponding hydrosaturated jet fuel or diesel product and leave the equipment.

According to the medium-pressure hydrocracking process of the present invention, the jet fuel and/or diesel cuts derived through the processing in the hydrosaturation system may also be returned to the same separation system, in which the hydrocracked liquid product is separated, for fractionation together with the hydrocracked liquid product. In this case, only a part of the jet fuel and/or diesel derived from the separation system is allowed to enter the hydrosaturation system for processing and the remainder leaves the equipment as products. The weight ratio of the jet fuel and/or diesel cuts entering into the hydrosaturation system to those leaving the equipment as products (abbreviated as reflux ratio below) generally ranges from 1:6 to 6:1 depending on the desired product quality.

According to the present invention, the medium-pressure hydrocracking conditions used in the hydrocracking system generally are: reaction temperature 360–400° C., pressure 4.0–10.0 MPa, preferably 4.0–8.0 MPa, hydrogen/oil volume ratio 800:1–1500:1, and space velocity 0.5–1.5 $h^{-1}$. The catalysts used in said hydrocracking process are any of those which are suitable for the medium-pressure hydrocracking process including the existing medium-pressure hydrocracking catalysts, such as those as disclosed in U.S. Pat. No. 6,043,178, U.S. Pat. No. 5,026,472, U.S. Pat. No. 4,172,815, etc.

Generally speaking, the hydrosaturation catalysts described in the present invention can be any of those which can hydrosaturate the jet fuel and/or diesel cuts in the hydrosaturation system, and are preferably selected from the reduced noble metals or non-noble metals of Groups VIB and/or VIII in the Periodic Table as the hydrogenation component, more preferably one or more metals selected from the group consisting of Pt, Pd, and Ni as the hydrogenation components of the reduced catalysts. The supports of such catalysts may be any of the suitable materials, such as refractory inorganic materials like alumina, silica, et al., as well as Y-, beta-type molecular sieves. These noble and non-noble catalysts may be prepared by any suitable methods including those methods that are well known in the prior art. For instance, CN 1,053,636 discloses the noble metal catalysts and their preparation; and CN 1,049,800 discloses he non-noble catalysts and their preparation. Both of these two references are herein incorporated as references of the present invention.

The process conditions used in the hydrosaturation are: reaction temperature 100–280° C., preferably 100–250° C., reaction pressure 0.5–3.0 MPa, preferably 1.0–2.0 MPa; hydrogen/oil volume ratio 200:1–1000:1; liquid hourly volume space velocity 1.0–6.0 $h^{-1}$.

The feed oil suitable for the process of the present invention may be the heavy oil cuts suitable for a medium-pressure hydrocracking process, such as the feed oil as described in U.S. Pat. No. 5,026,472, the vacuum distillates from the vacuum distillation devices of refineries, etc.

The fresh hydrogen described in the present invention may come from a hydrogen production system or the pipe net of the refinery. The fresh hydrogen substantively contains no impurities such as $H_2S$, $NH_3$, etc. and need not be further pressurized when used in the present invention.

The medium-pressure hydrocracking process of the present invention has the following characteristics compared with the prior arts:

1. On the basis of the prior hydrocracking process flow, recycling flow of a part or the whole of the jet fuel and/or diesel cuts is added, so that the low quality kerosene and/or diesel obtained in the medium-pressure hydrocracking are further improved and become high quality jet fuel and/or diesel products.

2. The kinetic and thermodynamic characteristics of the hydrosaturation reaction are fully considered from the angle of the process flow, so that the hydrosaturation reactions of the jet fuel and/or diesel occur under the optimum conditions, whereby the efficiency of the catalytic reaction is greatly raised.

3. The catalysts having high hydrosaturation activity and containing reduced metals of group VIB and/or group VIII may be used in the hydrosaturation reaction of the jet fuel and/or diesel cuts so that the reaction conditions are very mild, For example, the reaction may be performed under a pressure of the hydrogen source of the system, at a temperature of the corresponding cut fractions at the time of being withdrawn from the side-line of the separation system following the hydrocracking system, and so on.

4. Fresh hydrogen containing no catalyst poisons for the hydrosaturation reaction such as H.sub.2S, NH.sub.3, etc. is first used to hydrosaturate the jet fuel and/or diesel from hydrocracking, so that high activity of the hydrosaturation reaction is ensured.

5. The hydrosaturation of the jet fuel and/or diesel cuts derived in the hydrocracking has the particular advantage that the hydrosaturation catalyst can not be deactivated by poisons since the impurities like sulfur, nitrogen, etc. in the jet fuel and/or diesel cuts are substantively removed, whereby the conduction of the saturation of the aromatics with high efficiency is ensured.

6. The use of the reduced hydrosaturation catalysts preferably recommended by the solution of the present invention makes it possible to perform the hydrosaturation reaction of the jet fuel and/or diesel at lower pressures, whereby the investment in the equipment and the operating cost are greatly lowered.

7. The use of partial or complete recycle flow of the jet fuel and/or diesel has the advantages of the simplification of the process flow and the full use of the capacity of the hydrocracking equipment, so that the increase in the investment in the medium-pressure hydrocracking process of the present invention is very little compared with that in the corresponding conventional medium-pressure hydrocracking process. In most cases, the investment in the medium-pressure hydrocracking process of the present invention is even lower. In particular, the use of fresh hydrogen to first hydrosaturate the jet fuel and/or diesel cuts before the fresh hydrogen enters into the hydrocracking system makes it possible to fully and repeatedly use the fresh hydrogen system in case of very limited investment. Since the saturation of the aromatics in the jet fuel and/or diesel cuts can be performed in the hydrosaturation system, the operation pressure of the hydrocracking system can be further lowered, whereby the investment in the equipment is greatly reduced.

8. The combination of the hydrosaturation of the jet fuel and/or diesel cuts with the medium-pressure hydrocracking permits the precious hydrogen resource to be fully, effectively and reasonably utilized. Comparatively, the new process both retains the advantages of the prior medium-pressure hydrocracking, and overcomes the shortcoming of the prior medium-pressure hydrocracking that the hydrosaturation depth of the jet fuel and/or diesel cuts can not be ensured. In other words, the new process makes it possible to concentrate the limited hydrogen resource on the deep hydrosaturation of the jet fuel and/or diesel cuts so that the unnecessary deep hydrogenation of naphtha as in high-pressure hydrocracking is avoided.

The technical solution of the present invention is described below in combination with the drawings.

As shown in FIG. 1, the feed oil from line 1 is, after pressurized by oil pump 2, mixed with the hydrogen-containing vapor from phase separator 12 and pressurized by make-up hydrogen compressor 18 and the recycling hydrogen from recycle compressor 5, and fed into hydrocracking system 3 to react. After cooled by heat exchange, the reaction product is separated into a vapor phase and a liquid phase through a high pressure separator 4. The vapor phase is pressurized and recycled by recycle compressor 5, and the liquid phase is separated into different products according to the boiling points of the cut fractions in following distillation system 6. The liquefied petroleum gas leaves the equipment through line 13; the light and heavy naphthas leave the equipment through lines 14 and 15 respectively. The tail oil can either be partly or completely recycled back to hydrocracking system 3 through line 10 for processing, or partly or completely leave the equipment directly through line 11. A part of the separated jet fuel cut withdrawn through line 16 and/or the diesel cut withdrawn through line 17 can partly mix with the fresh hydrogen from line 9 by recycle pump 7 and enter into hydrosaturation reactor 8, and the product of the hydrosaturation goes to phase separator 12 for vapor-liquid separation. The vapor phase goes to the cracking system 3 after pressurization by supplement hydrogen compressor 18, and the liquid phase returns to separation system 6.

Figure 2:
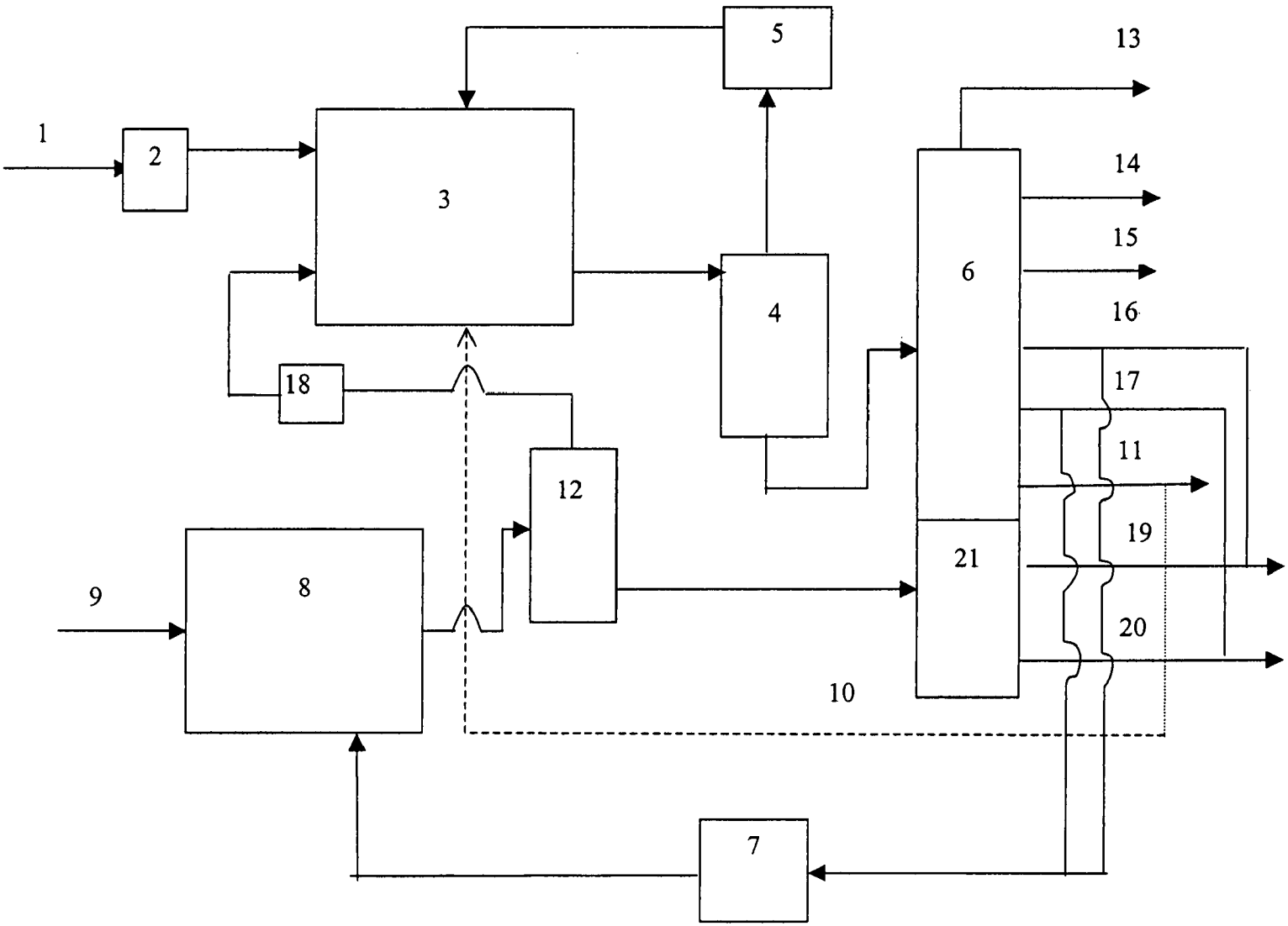
FIG. 2 shows an embodiment of the present invention, in which the hydrosaturated product and the hydrocracked, separated liquid product enter different separation systems respectively.

As shown in FIG. 2, the feed oil from line 1 is, after pressurized by oil pump 2, mixed with the hydrogen-containing vapor from phase separator 12 and pressurized by make-up hydrogen compressor 18 and the recycling hydrogen from recycle compressor 5, and fed into hydrocracking system 3 to conduct the reaction. After cooled by heat exchange, the reaction product is separated into a vapor phase and a liquid phase through high separator 4. The vapor phase is pressurized and recycled by recycle compressor 5, and the liquid phase is separated into different products according to the boiling points of the cut fractions in following distillation system 6. The liquefied petroleum gas leaves the equipment through line 13; the light and heavy naphthas leave the equipment through lines 14 and 15 respectively. The tail oil can either be partly or completely recycled back to the hydrocracking system 3 through line 10 for processing, or partly or completely leave the equipment directly through line 11. A part of the separated jet fuel cut withdrawn through line 16 and/or the diesel cut withdrawn through line 17 can partly or completely mix with the fresh hydrogen from line 9 by recycle pump 7 and enter into hydrosaturation reactor 8, and the product of the hydrosaturation goes to phase separator 12 for vapor-liquid separation. The vapor phase goes to the cracking system 3 after pressurization by make-up hydrogen compressor 18, and the liquid phase goes to separation system 21 directly. The jet fuel cut withdrawn through line 19 and/or the diesel cut withdrawn through line 20 separated in the separation system leave the equipment as the final products. If the aforesaid jet fuel cut withdrawn through line 16 and/or the diesel cut withdrawn through line 17 are partly recycled to hydrosaturation system 8 for processing, the remainder mixes with the corresponding jet fuel withdrawn through line 19 or the diesel withdrawn through line 20 and leaves the equipment together as the final product.

The effects of the technical solutions of the present invention are further explained by the following Examples.

Table 1 shows the major properties of a typical feed oil for medium-pressure hydrocracking, and this feed is used in all the following Examples and Comparative Examples.

COMPARATIVE EXAMPLES 1–2

A medium-pressure hydrocracking process comprising a hydrotreating step and a hydrocracking step in series is used. The process conditions used and product distribution are shown in Table 2. The properties of the jet fuel produced are shown in Table 3. It can be seen from Table 3 that the jet fuel produced in the medium-pressure hydrocracking process contains more aromatics, and the smoking point is 16–18 mm, so the requirement of the specifications for the jet fuel cannot be met. Therefore, the applicability of this medium-pressure hydrocracking process is greatly limited. The properties of the diesel produced are shown in Table 4. It can be seen from Table 4 that the volume contents of the aromatics of the diesel produced in the medium-pressure hydrocracking process are lower than 25%, but higher than 15%. The cetane number is even lower than 45 at 5.0 MPa, which does not attain the required specifications for diesel.

EXAMPLES 1–3

On the basis of the hydrocracking process of Comparative Examples 1–2, a hydrosaturation system is added. Jet fuel and other products are produced under different process conditions. The process flow is shown in FIG. 1. Table 5 shows the process conditions and results. It can be seen from Table 5 that in the jet fuel produced using the process of the present invention, the content of aromatics is greatly lowered, and smoking point of the jet fuel is raised, so it is a high quality jet fuel.

EXAMPLES 4–5

On the basis of the hydrocracking process of Comparative Example 2, only an individual hydrosaturation system of diesel (Example 4), or a mixing hydrosaturation system of jet fuel and diesel (Example 5) is added. Jet fuel and/or diesel products are produced under different process conditions. Refer to FIG. 2 for the process flow. In Example 4, the diesel cut separated from the hydrocracking product by the separation system completely enters into the hydrosaturation system for processing. In Example 5, the jet fuel and diesel cuts separated from the hydrocracking product by the separation system completely enter into the hydrosaturation system for processing. The process conditions and results of Examples 4 and 5 are shown in Tables 5–6. It can be seen from Table 6 that in the diesel produced using the process of the present invention, the content of aromatics is greatly lowered, and the cetane number is greatly raised. And therefore the process of the present invention is able to produce the diesel product which accords with the world fuel standard III. In case of the mixing hydrogenation of jet fuel and diesel (Example 5), the aromatics and smoking point etc. of the jet fuel (Table 5) also entirely meet the specifications.

EXAMPLES 6–8

On the basis of the hydrocracking process of Comparative Examples 1–2, a hydrosaturation system is added. Jet fuel and other products are produced under different process conditions. The process flow is shown in FIG. 1. Table 7 shows the process conditions and results. It can be seen from Table 7 that in the jet fuel produced using the process of the present invention, the content of aromatics is greatly lowered, and smoking point of the jet fuel is raised, so it is a high quality jet fuel.

TABLE 1

Properties of the feed oil

| | |
|---|---|
| Density (20° C.), g/cm$^3$ | 0.9047 |
| Distillation range, ° C. IBP/10% | 328/376 |
| 30%/50% | 403/423 |
| 70%/90% | 440/466 |
| 95%/EBP | 483/508 |
| Sulfur, wt % | 0.55 |
| Nitrogen, μg/g | 1599 |

TABLE 2

Reaction conditions and product distribution

| | No. of Comparative Example | |
|---|---|---|
| | Comparative Example 1 | Comparative Example 2 |
| Catalyst | 3936/3905* | 3936/3905* |
| Pressure, MPa | 7.5 | 5.0 |
| Temperature, ° C. | 377/380 | 380/380 |
| LHVSV**, h$^{-1}$ | 0.9/1.60 | 0.7/1.6 |
| Hydrogen/oil volume ratio | 1000:1 | 1000:1 |
| Product distribution, ° C. | | |
| <82 | 6.5 | 6.3 |
| 82–132 | 12.1 | 11.7 |
| 132–282 | 36.3 | 36.5 |
| 282–350 | 9.3 | 14.3 |
| >350 | 32.8 | 28.2 |

*Catalyst No. 3936 is a commercial hydrotreating catalyst produced in the Catalyst Plant of the Fushun Third Petroleum Plant, and Catalyst No. 3905 is a commercial hydrocracking catalyst produced in the same Plant).
**Liquid hourly volume space velocity.

TABLE 3

Properties of the jet fuel produced in Comparative Examples 1–2

| | No. of Comparative Example | |
|---|---|---|
| | Comparative Example 1 | Comparative Example 2 |
| Density (20° C.), g/cm$^3$ | 0.8173 | 0.8195 |
| Distillation range, ° C. | ASTM D 86 | ASTM D 86 |
| IBP/10% | 148/164 | 148/165 |
| 30%/50% | 179/198 | 177/194 |
| 70%/90% | 219/244 | 215/240 |
| 98%/FBP | 261/263 | 255/260 |
| Freezing point, ° C. | <−60 | <−60 |
| Flashing point, ° C. | 39 | 40 |
| Smoking point, mm | 18 | 16 |
| Aromatics, v % | 20.9 | 24.4 |
| Sulfur content, μg/g | 3 | 5 |

TABLE 4

Properties of the diesel produced in Comparative Examples 1-2

| | No. of Comparative Example | |
|---|---|---|
| | Comparative Example 1 | Comparative Example 2 |
| Density (20° C.), g/cm$^3$ | 0.8459 | 0.8601 |
| Distillation range (° C., ASTM D 86) | 270–345 | 266–343 |
| Freezing point, ° C. | −5 | −9 |
| Flashing point, ° C. | 155 | 140 |
| Cetane number | 49 | 41 |
| Aromatics, v % | 18.9 | 24.3 |
| Sulfur content, μg/g | 3.5 | 5 |

TABLE 5

Results of hydrosaturation of the jet fuel produced by the present invention

| | Example No. | | | |
|---|---|---|---|---|
| | Example 1 | Example 2 | Example 3 | Example 5 |
| Type and No. Of Catalyst | Reduced non-noble metal catalyst A | Reduced non-noble metal catalyst B | Reduced noble metal catalyst C | Reduced non-noble metal catalyst A |
| Physical properties of the catalysts before use | | | | |
| Content of metals* | Elementary nickel, 34 wt % Nickel oxide, 20 wt % | Elementary nickel, 29 wt % Nickel oxide, 17 wt % | Pd/Pt atom ratio = 0.2 Pd + Pt = 1.0 wt % | Elementary nickel, 34 wt % Nickel oxide, 20 wt % |
| Alumina, wt % | Balanced | Balanced | Balanced | Balanced |
| Specific surface area, m$^2$/g | 156 | 142 | 302 | 156 |
| Pore volume, ml/g | 0.25 | 0.28 | 0.31 | 0.25 |
| Process conditions | | | | |
| Reflux ratio of jet fuel | 1:1 | 3:1 | 1:3 | |
| Hydrogen partial pressure, MPa | 1.2 | 1.3 | 3.0 | 1.5 |
| Temperature, ° C. | 120 | 130 | 250 | 200 |
| LHVSV**, h$^{-1}$ | 2.0 | 3.0 | 4.0 | 2.0 |
| Hydrogen/oil volume ratio | 300:1 | 400:1 | 400:1 | 400:1 |
| Properties of jet fuel product | | | | |
| Density (20° C.), g/cm$^3$ | 0.8080 | 0.8101 | 0.7981 | 0.8110 |
| Distillation range, ° Ct | | ASTM D 86 | | |
| IBP/10% | 147/164 | 150/164 | 146/159 | 150/163 |
| 30%/50% | 177/198 | 179/200 | 169/189 | 178/200 |
| 70%/90% | 218/243 | 220/246 | 210/238 | 221/245 |
| 98%/FBP | 260/263 | 262/265 | 260/264 | 261/264 |

TABLE 5-continued

Results of hydrosaturation of the jet fuel produced by the present invention

| | Example No. | | | |
|---|---|---|---|---|
| | Example 1 | Example 2 | Example 3 | Example 5 |
| Smoking point, mm | 27 | 28 | 31 | 26 |
| Aromatics, v % | 5 | 4 | 0.7 | 7 |

*The Ni contents in the catalysts used in Examples 1, 2 and 5 are measured after reduction and before use, but Ni exists in both elementary Ni and reduced Ni.
**Same meaning as in Table 2.

TABLE 6

Results of diesel hydrosaturation of the present invention

| | Example No. | |
|---|---|---|
| | Example 4 | Example 5 |
| Feedstock | Comparative Example 2 | Comparative Example 2 |
| Catalyst | Catalyst B | Catalyst A |
| Process conditions | | |
| Hydrogen partial pressure, MPa | 2.0 | 1.5 |
| Reaction temperature, ° C. | 220 | 200 |
| LHVSV*, h$^{-1}$ | 2.0 | 2.0 |
| Hydrogen/oil volume ratio | 400:1 | 400:1 |
| Properties of diesel product | | |
| Density (20° C.), g/cm$^3$ | 0.8405 | 0.8386 |
| Distillation range (° C., ASTM D 86) | 265–343 | 265–343 |
| Aromatics, v % | 14.1 | 12.2 |
| Cetane number | 53 | 54 |

*Same meaning as in Table 2.

TABLE 7

Results of hydrosaturation of the jet fuel produced by the present invention

| | Example No. | | |
|---|---|---|---|
| | Example 6 | Example 7 | Example 8 |
| Type and No. of Catalyst | Reduced non-noble metal catalyst D | Reduced non-noble metal catalyst E | Reduced non-noble metal catalyst F |
| Physical properties of the catalysts before use | | | |
| Content of metals* | Elementary nickel, 15 wt % Nickel oxide, 11 wt % | Elementary nickel, 20 wt % Nickel oxide, 14 wt % | Elementary nickel, 38 wt % Nickel oxide, 22 wt % |
| Alumina, wt % | Balanced | Balanced | Balanced |
| Specific surface area, m$^2$/g | 171 | 158 | 130 |
| Pore volume, ml/g | 0.29 | 0.27 | 0.22 |
| Process conditions | | | |
| Reflux ratio of jet fuel | 1:1 | 1:2 | 3:1 |
| Hydrogen partial pressure, MPa | 1.5 | 1.2 | 2.0 |

TABLE 7-continued

Results of hydrosaturation of the jet fuel produced by the present invention

| | Example No. | | |
|---|---|---|---|
| | Example 6 | Example 7 | Example 8 |
| Temperature, ° C. | 120 | 130 | 150 |
| LHVSV**, $h^{-1}$ | 2.0 | 4.0 | 2.0 |
| Hydrogen/oil volume ratio | 300:1 | 400:1 | 400:1 |
| Properties of jet fuel product | | | |
| Density (20° C.), $g/cm^3$ | 0.8082 | 0.8102 | 0.8091 |
| Distillation range, ° Ct | | ASTM D 86 | |
| IBP/10% | 145/162 | 145/161 | 145/157 |
| 30%/50% | 176/194 | 172/194 | 161/184 |
| 70%/90% | 215/238 | 209/232 | 208/237 |
| 98%/FBP | 257/263 | 253/264 | 258/264 |
| Smoking point, mm | 28 | 29 | 27 |
| Aromatics, v % | 5 | 4 | 5 |

*The Ni contents in the catalysts used in Examples 1, 2 and 5 are measured after reduction and before use, but Ni exists in both elementary Ni and reduced Ni.
**Same meaning as in Table 2.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We I claim:

1. A medium-pressure hydrocracking process comprising the steps of contacting feed oil with a hydrocracking catalyst in a hydrocracking system under a medium pressure and hydrocracking conditions; separating the hydrocracking reaction product into a vapor fraction which is recycled to the hydrocracking system as recycling hydrogen, and a liquid fraction which is further separated in a separating system to produce distillates including jet fuel and/or diesel (hereinafter referred to as hydrocracked jet fuel and/or diesel) cuts; feeding a part or all of the hydrocracked jet fuel and/or diesel cuts into a hydrosaturation system where the cuts come into contact with a hydrosaturation catalyst and react with fresh hydrogen under hydrosaturation conditions; separating the hydrosaturation reaction product into a hydrogen-containing vapor which enters into the hydrocracking system as make-up hydrogen, and jet fuel and/or diesel (hereinafter referred to as the hydrosaturated jet fuel and/or diesel) which enter into a separation system for processing, wherein medium pressure is a pressure of from about 4.0 to about 10.0 MPa, and wherein said hydrosaturation reaction is carried out under a pressure of 0.5–3.0 MPa, at a temperature of 100–280° C., with a reduced hydrosaturation catalyst comprising at least 50 wt % of nickel based on its oxide.

2. The process according to claim 1, wherein a part or all of the hydrocracked jet fuel cut enters into a hydrosaturation system for processing.

3. The process according to claim 1, wherein a part or all of the hydrocracked diesel cut enters into a hydrosaturation system for processing.

4. The process according to claim 1, wherein a part or all of the hydrocracked jet fuel and diesel cuts enter into a hydrosaturation system for processing.

5. The process according to claim 1, wherein all of the hydrocracked jet fuel and/or diesel cuts enter into a hydrosaturation system for processing, and the hydrosaturated jet fuel and/or diesel enter into an individual separation system for processing, which then separately leaves the equipment as products.

6. The process according to claim 1, wherein a part of the hydrocracked jet fuel and/or diesel cuts enter into a hydrosaturation system for processing, and the hydrosaturated jet fuel and/or diesel enter into an individual separation system for processing, which then mixes with the other part of the corresponding hydrocracked jet fuel and/or diesel cuts and separately leaves the equipment as products.

7. The process according to claim 1, wherein both the liquid fraction of the hydrocracking reaction product and the hydrosaturated jet fuel and/or diesel enter the same separation system for fractionation together, and a part of the separated jet fuel and/or diesel cuts enter into the hydrosaturation system for processing, and the remaining part of the separated jet fuel and/or diesel cuts leaves the equipment as products.

8. The process according to claim 1, wherein said hydrosaturation catalyst comprises at least 54 wt % of nickel based on nickel oxide.

9. The process according to claim 1, wherein the hydrocracking reaction is carried out under a pressure of 4.0–10.0 MPa, at a temperature of 360–400° C., with a hydrogen/oil volume ratio of 800:1–1500:1, and a liquid hourly volume space velocity of 0.5–1 .5 $h^{-1}$.

10. The process according to claim 1, wherein the hydrosaturation reaction is carried out under a pressure of 0.5–3.0 MPa, at a temperature of 100–280° C., with a hydrogen/oil volume ratio of 200:1–1000:1, and a liquid hourly volume space velocity of 1.0–6.0 $h^{-1}$.

11. The process according to claim 1, wherein said fresh hydrogen comes from a hydrogen-production system or the pipe net of the refinery and contains no such impurities as $H_2S$ and $NH_3$, which is used directly in the process without being additionally pressurized.

12. The process according to claim 8, wherein said hydrosaturation catalyst comprises from about 54 wt % to about 63 wt % of nickel based on nickel oxide.

13. The process according to claim 9, wherein said hydrocracking pressure is 4.0–8.0 MPa.

14. The process according to claim 10, wherein said hydrosaturation temperature is 100–250° C., and said hydrosaturation pressure is 1.0–2.0 MPa.

15. The process according to claim 7, wherein the weight ratio of said jet fuel and/or diesel distillate entering into the hydrosaturation system to those leaving the system as jet fuel and/or diesel products is 1:6–6:1.

16. A medium-pressure hydrocracking process comprising the steps of contacting feed oil with a hydrocracking catalyst in a hydrocracking system under a medium pressure and hydrocracking conditions; separating the hydrocracking reaction product into a vapor fraction which is recycled to the hydrocracking system as recycling hydrogen, and a liquid fraction which is further separated in a separating system to produce distillates including jet fuel and/or diesel (hereinafter referred to as hydrocracked jet fuel and/or diesel) cuts; feeding a part or all of the hydrocracked jet fuel and/or diesel cuts into a hydrosaturation system where the cuts come into contact with a hydrosaturation catalyst and react with fresh hydrogen under hydrosaturation conditions; separating the hydrosaturation reaction product into a hydrogen-containing vapor which enters into the hydrocracking system as make-up hydrogen, and jet fuel and/or diesel (hereinafter referred to as the hydrosaturated jet fuel and/or diesel) which enter into a separation system for processing, wherein medium pressure is a pressure of from about 4.0 to about 10.0 MPa, and wherein said hydrosaturation reaction is carried out under a pressure of 0.5–3.0 MPa, at a temperature of 100–280° C.

17. The process of claim 16 wherein said fresh hydrogen comes from a hydrogen-production system or the pipe net of the refinery and contains no such impurities as $H_2S$ and $NH_3$, which is used directly in the process without being additionally pressurized.

18. The process of claim 16 wherein said hydrosaturation temperature is 100–250° C., and said hydrosaturation pressure is 1.0–2.0 MPa.

19. The process of claim 16 wherein said hydrosaturation reaction is carried out in the presence of a reduced hydrosaturation catalyst comprising at least 30 wt % of nickel based on its oxide.

20. The process of claim 18 wherein the hydrosaturation catalyst comprises from 30 wt %–70 wt % nickel based on its oxide.

* * * * *